US009202646B2

(12) United States Patent
Obenshain et al.

(10) Patent No.: US 9,202,646 B2
(45) Date of Patent: Dec. 1, 2015

(54) CIRCUIT BREAKER LOCKOUT

(71) Applicant: Panduit Corp., Tinley Park, IL (US)

(72) Inventors: Marc R. Obenshain, Cumming, GA (US); David M. Howard, Dawsonville, GA (US); Mark J. Pfaller, Woodstock, GA (US)

(73) Assignee: Panduit Corp., Tinley Park, IL (US)

( * ) Notice: Subject to any disclaimer, the term of this patent is extended or adjusted under 35 U.S.C. 154(b) by 123 days.

(21) Appl. No.: 14/052,981

(22) Filed: Oct. 14, 2013

(65) Prior Publication Data

US 2014/0102865 A1 Apr. 17, 2014

Related U.S. Application Data

(60) Provisional application No. 61/714,416, filed on Oct. 16, 2012.

(51) Int. Cl.
*H01H 9/20* (2006.01)
*H01H 9/28* (2006.01)

(52) U.S. Cl.
CPC *H01H 9/20* (2013.01); *H01H 9/283* (2013.01)

(58) Field of Classification Search
CPC ..... H01H 9/20; H01H 9/26; H01H 9/283
USPC ..... 200/43.11
See application file for complete search history.

(56) References Cited

U.S. PATENT DOCUMENTS

| | | | | |
|---|---|---|---|---|
| 5,079,390 | A | 1/1992 | Costanzo et al. | |
| 5,147,991 | A | 9/1992 | Jordan, Sr. | |
| 5,181,602 | A * | 1/1993 | Kozlowski et al. | 200/43.15 |
| 5,256,838 | A | 10/1993 | Benda | |
| 5,300,740 | A * | 4/1994 | Benda | 200/43.14 |
| 5,322,980 | A | 6/1994 | Benda | |
| 5,500,495 | A | 3/1996 | Benda et al. | |
| 5,543,593 | A * | 8/1996 | Turek | 200/43.11 |
| 5,577,599 | A | 11/1996 | Turek et al. | |
| 7,262,376 | B2 * | 8/2007 | Brojanac et al. | 200/43.14 |
| 7,692,108 | B1 | 4/2010 | Larranaga et al. | |
| 2012/0205224 | A1 | 8/2012 | Hackett | |

FOREIGN PATENT DOCUMENTS

| | | |
|---|---|---|
| CA | 2577167 A1 | 8/2008 |
| EP | 0824263 A2 | 2/1998 |

(Continued)

OTHER PUBLICATIONS

North Safety Products Lockouts & Tagouts, front cover; p. 4; and back cover, Nov. 2007, 3 pages.

*Primary Examiner* — Kyung Lee

(74) *Attorney, Agent, or Firm* — Christopher S. Clancy; Aimee E. McVady

(57) ABSTRACT

The present invention is directed to a circuit breaker lockout. The circuit breaker lockout includes a base, a screw positioned within the base and a jaw. The base has a top and a bottom. The jaw has a top, a bottom and sides that define an open center having a first length. The base is positioned between the sides of the jaw in the open center. The bottom of the base extends in the open center and the top of the base extends above the top of the jaw. The jaw slides with respect to the base when the screw is actuated to decrease the first length of the open center to a second length thereby enabling the lockout to surround the switch of a circuit breaker.

19 Claims, 8 Drawing Sheets

(56) References Cited

FOREIGN PATENT DOCUMENTS

| | | | |
|---|---|---|---|
| JP | 5851524 | U | 4/1983 |
| JP | 05074312 | A | 3/1993 |
| WO | 03/041102 | A1 | 5/2003 |
| WO | 2006/105288 | A2 | 10/2006 |

* cited by examiner

CIRCUIT BREAKER LOCKOUT

CROSS REFERENCE TO RELATED APPLICATION

This application claims priority to U.S. Provisional Application No. 61/714,416, filed Oct. 16, 2012, the subject matter of which is herein incorporated by reference in its entirety.

FIELD OF THE INVENTION

The present invention relates to a circuit breaker lockout, and more particularly to a circuit breaker lockout with an improved grip.

BACKGROUND OF THE INVENTION

Circuit breaker lockout devices are known in the art. One example of a circuit breaker lockout device is disclosed in U.S. Pat. No. 5,300,740. U.S. Pat. No. 5,300,740 discloses a circuit breaker lockout for multi-pole breaker switches. The circuit breaker lockout includes a front member and a rear member slidingly secured to each other via a screw. To install the circuit breaker lockout, the front member and the rear member are positioned on opposite sides of a tie bar that joins the circuit breaker switches. The screw is tightened to draw the front and rear members toward each other. The rear member includes a bottom lug that is positioned under the tie bar to prevent the circuit breaker lockout from being withdrawn. The circuit breaker lockout is designed to be used only with multi-pole breakers that use a tie bar.

As such, it is desirable to provide a versatile circuit breaker lockout that may be used to lock either single or multi-pole breaker switches. It is also desirable to provide a circuit breaker lockout with an improved grip that reduces the damage caused to the circuit breaker switch during use.

SUMMARY OF THE INVENTION

The present invention is related to a circuit breaker lockout. The circuit breaker lockout includes a base and a sliding jaw. The base has a top, a bottom and a screw positioned within the base. The jaw has a top, a bottom and sides defining an open center having a first length. The base is positioned between the sides of the jaw in the open center. The bottom of the base extends in the open center and the top of the base extends above the top of the jaw. To secure the circuit breaker lockout, the jaw slides with respect to the base when the screw is actuated thereby decreasing the first length of the open center to a second length to enable the lockout to surround the switch of a circuit breaker.

DETAILED DESCRIPTION

The present invention is directed to a circuit breaker lockout 20. The circuit breaker lockout 20 may be installed on a single pole circuit breaker or multi-pole circuit breakers, as desired.

Figure 1:
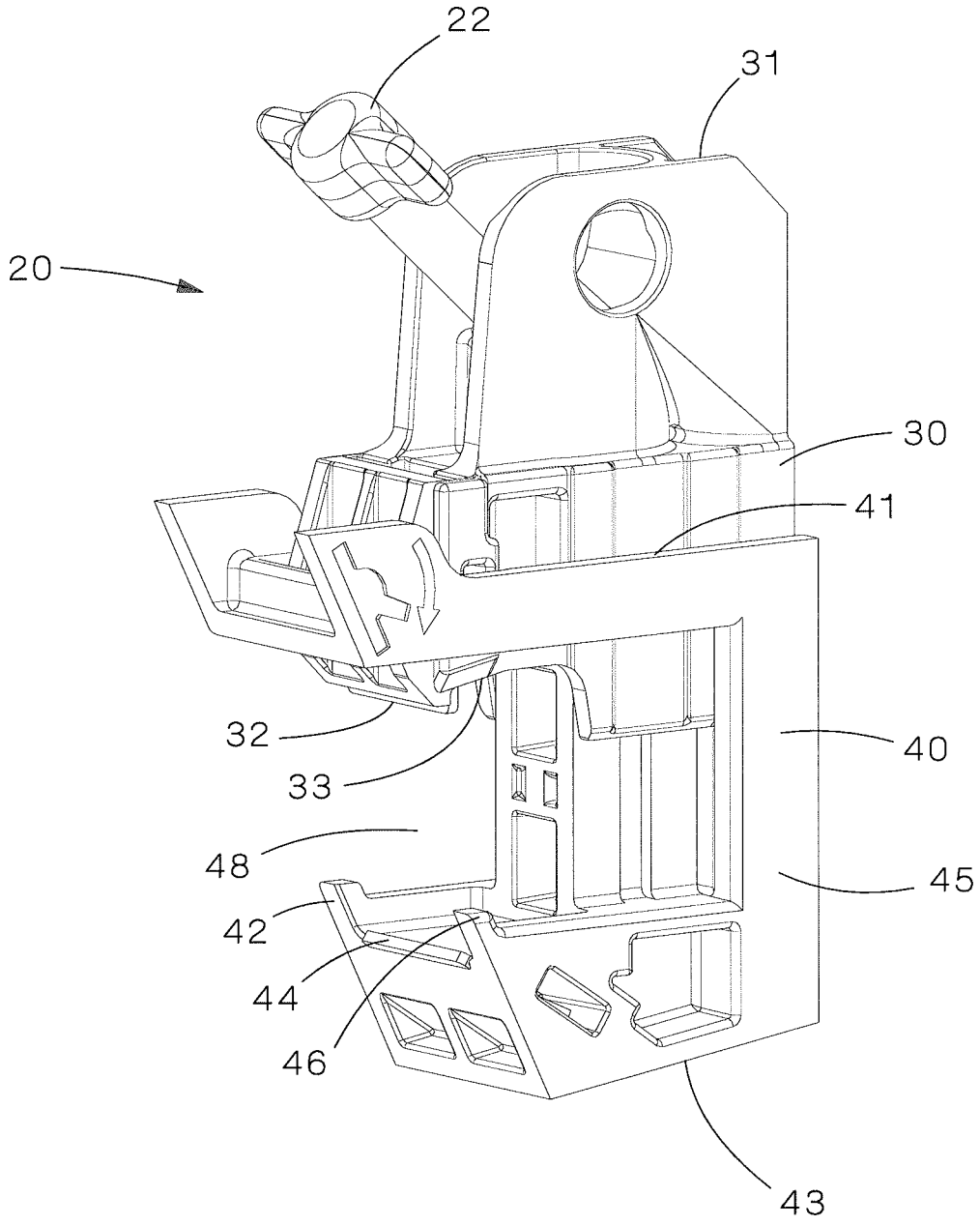
FIG. 1 is a perspective view of the circuit breaker lockout of the present invention.
Figure 2:
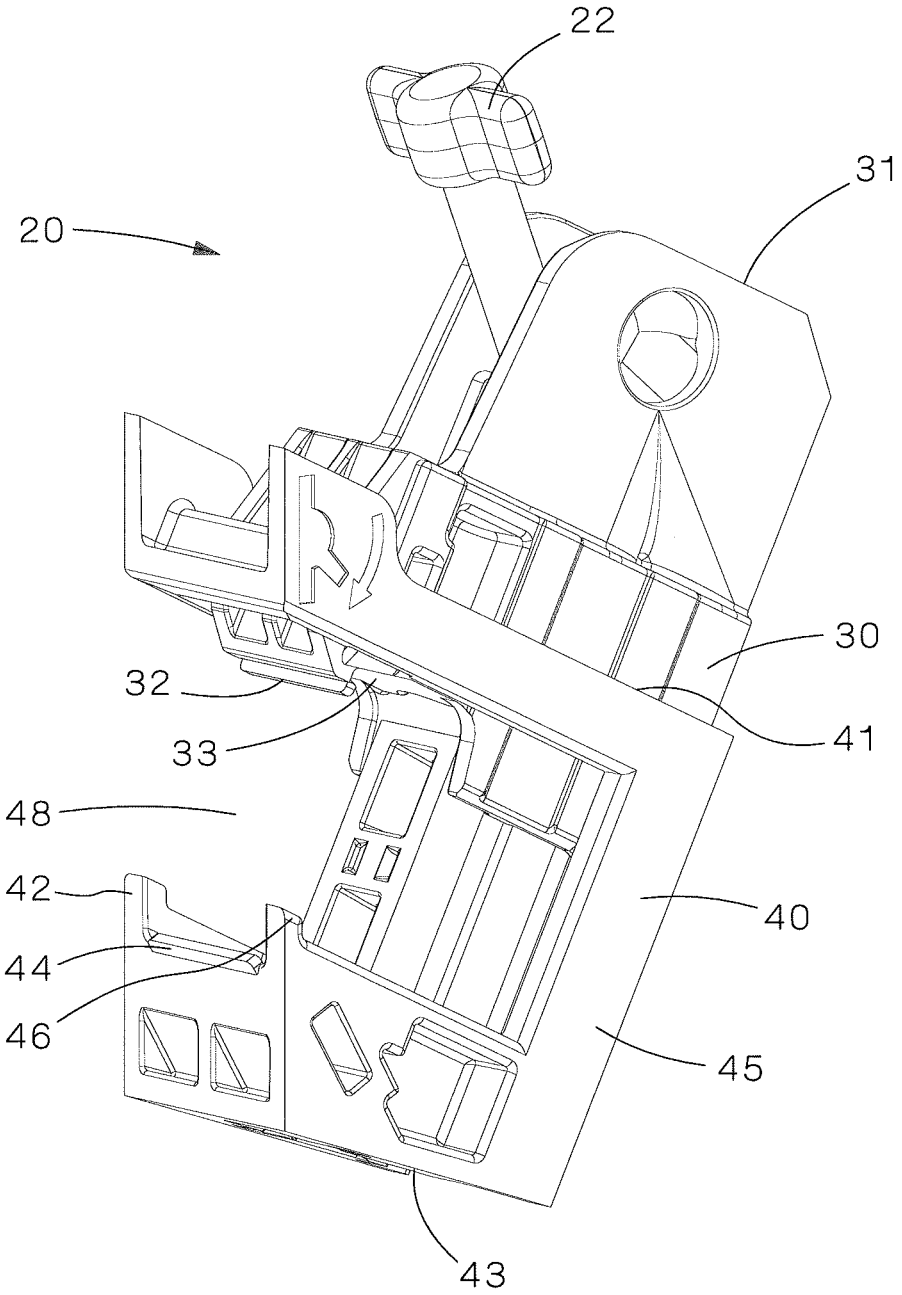
FIG. 2 is a perspective view of the circuit breaker lockout of FIG. 1 ready to be installed on a circuit breaker.
Figure 3:
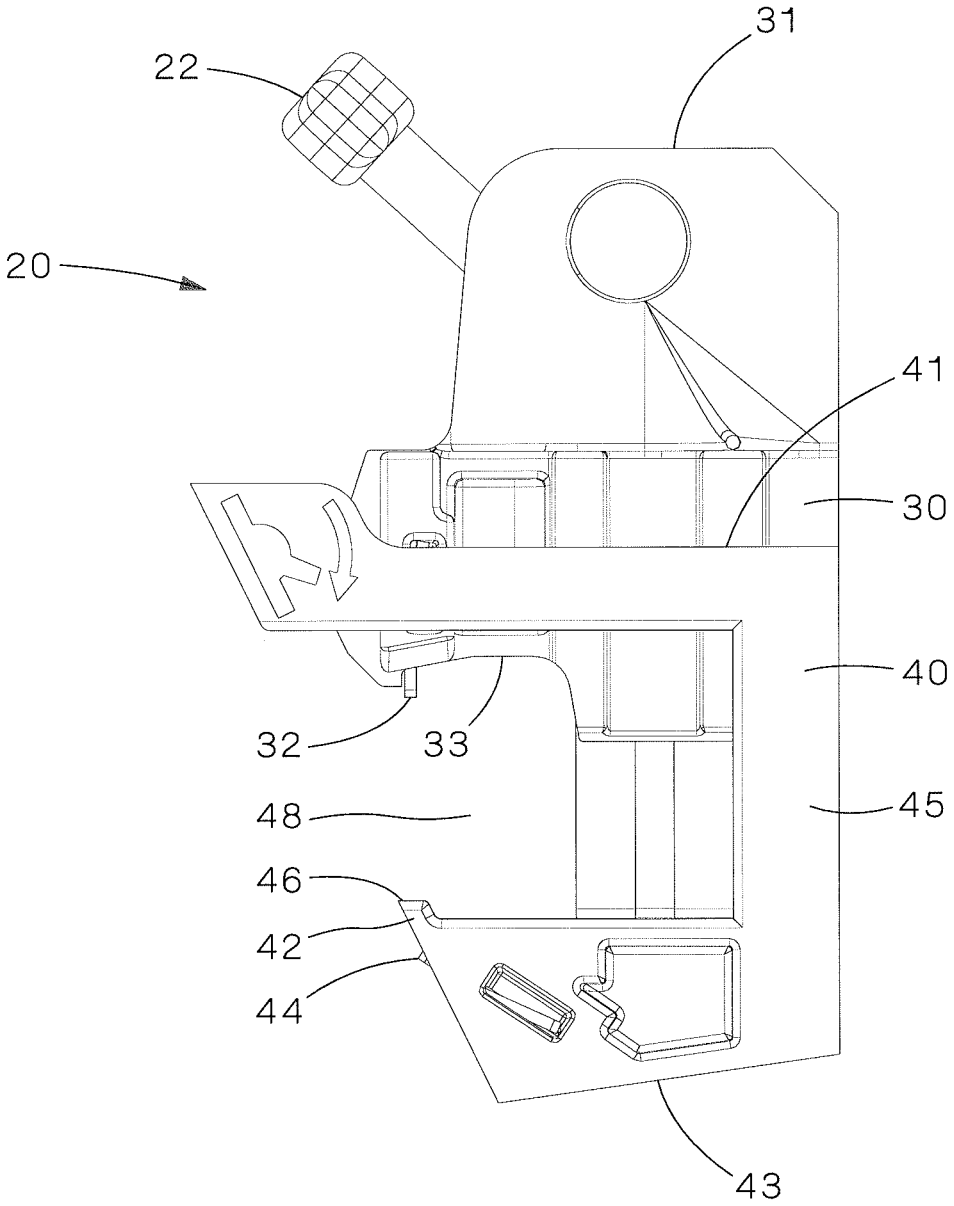
FIG. 3 is a side view of the circuit breaker lockout of FIG. 1.
Figure 4:
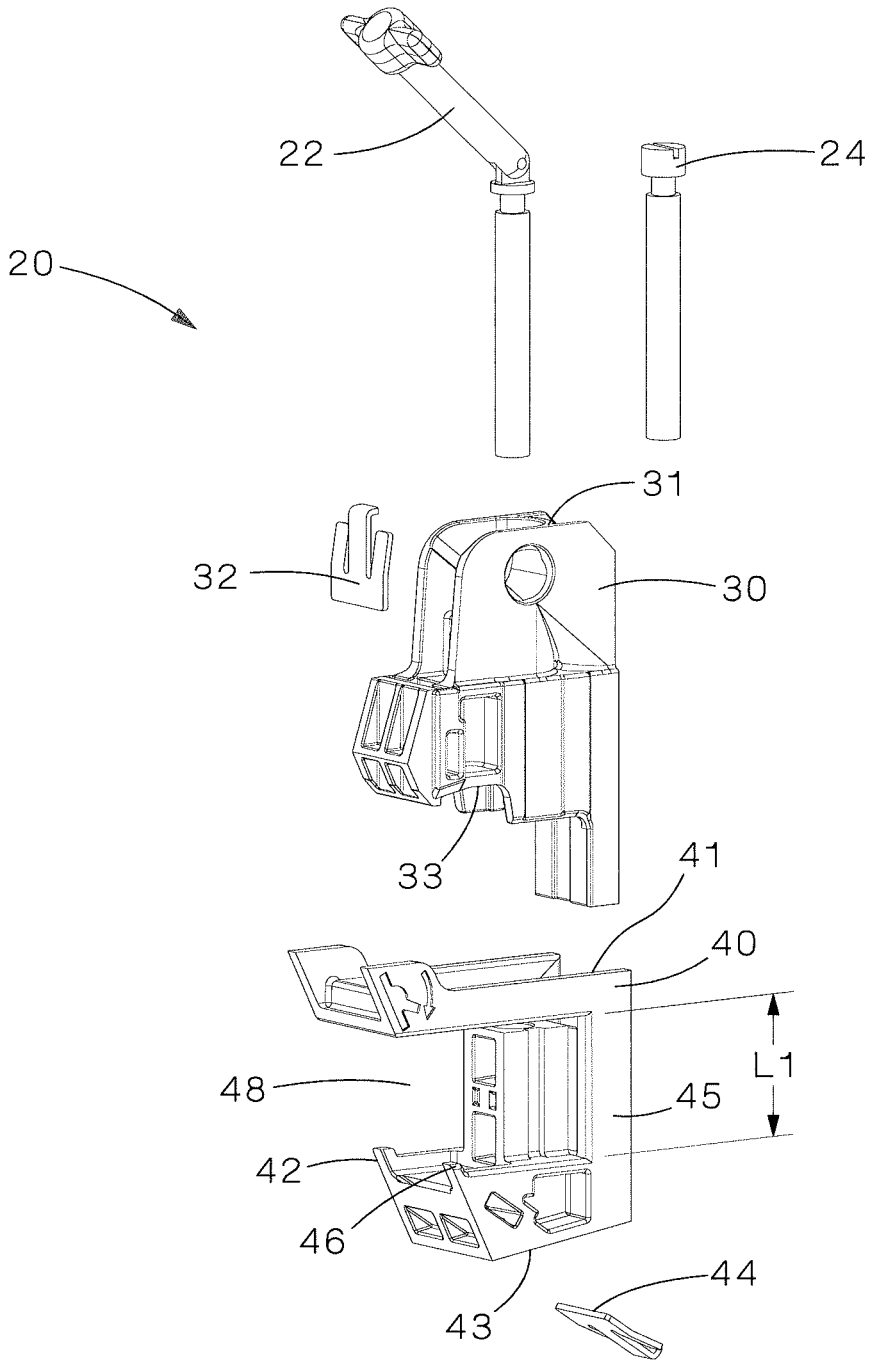
FIG. 4 is an exploded view of the circuit breaker lockout of FIG. 1.

FIGS. 1-4 illustrate the two piece circuit breaker lockout 20. The lockout 20 includes a stationary base 30 and a traveling jaw 40 that slides with respect to the base 30. The base 30 includes a top 31 and a bottom 33. The jaw 40 includes a top 41, a bottom 43, and sides 45 that define an open center 48 having a first length L1. As illustrated in FIG. 4, the lockout 20 includes either a toggle screw 22 or a set screw 24 for actuating the traveling jaw 40 to install the lockout 20.

FIG. 4 also illustrates the metal blades 32, 44 positioned to be installed in the base 30 and the jaw 40, respectively. The metal blade 32 installed in the base 30 is positioned in a vertical direction with respect to the base 30. The metal blade 44 installed in the traveling jaw 40 is positioned at an angle in the jaw 40 to ensure proper placement on a breaker switch 51 (see FIG. 6). The metal blade 44 is positioned as close to the end 42 of the jaw 40 as possible (see FIG. 8). The metal blades 32, 44 are heat treated steel to generate a strong and durable bite over a wide area of the surface. The metal blades 32, 44 are offset from each other to provide an improved grip on the circuit breaker switch 51, 61 (see FIGS. 6 and 8). The upper blade 32 is positioned further out towards the free end of the breaker switch in relation to lower blade 44 that is located close to the face of the breaker. This positions the upper blade 32 to resist the movement of the breaker switch through its arc if an attempt is made to forcefully remove the circuit breaker lockout 20. Thus, the combined metal blades 32, 44 provide a stronger grip than prior art circuit breaker lockouts thereby requiring a significant force to remove the lockout 20. As a result, once the lockout 20 is installed, the circuit breaker will remain locked out.

The jaw 40 also includes teeth 46 and an open channel 48 having a first length Ll. The teeth 46 are molded into the end 42 of the jaw 40 to ensure the lockout 20 is properly positioned on the breaker switch. The open center 48 allows the lockout to surround the switch of the circuit breaker. The open center 48 in the jaw 40 enables the lockout to engage a circuit breaker more squarely and securely. The open center 48 also aides in preventing the lockout 20 from being twisted off of the circuit breaker.

Figure 5:
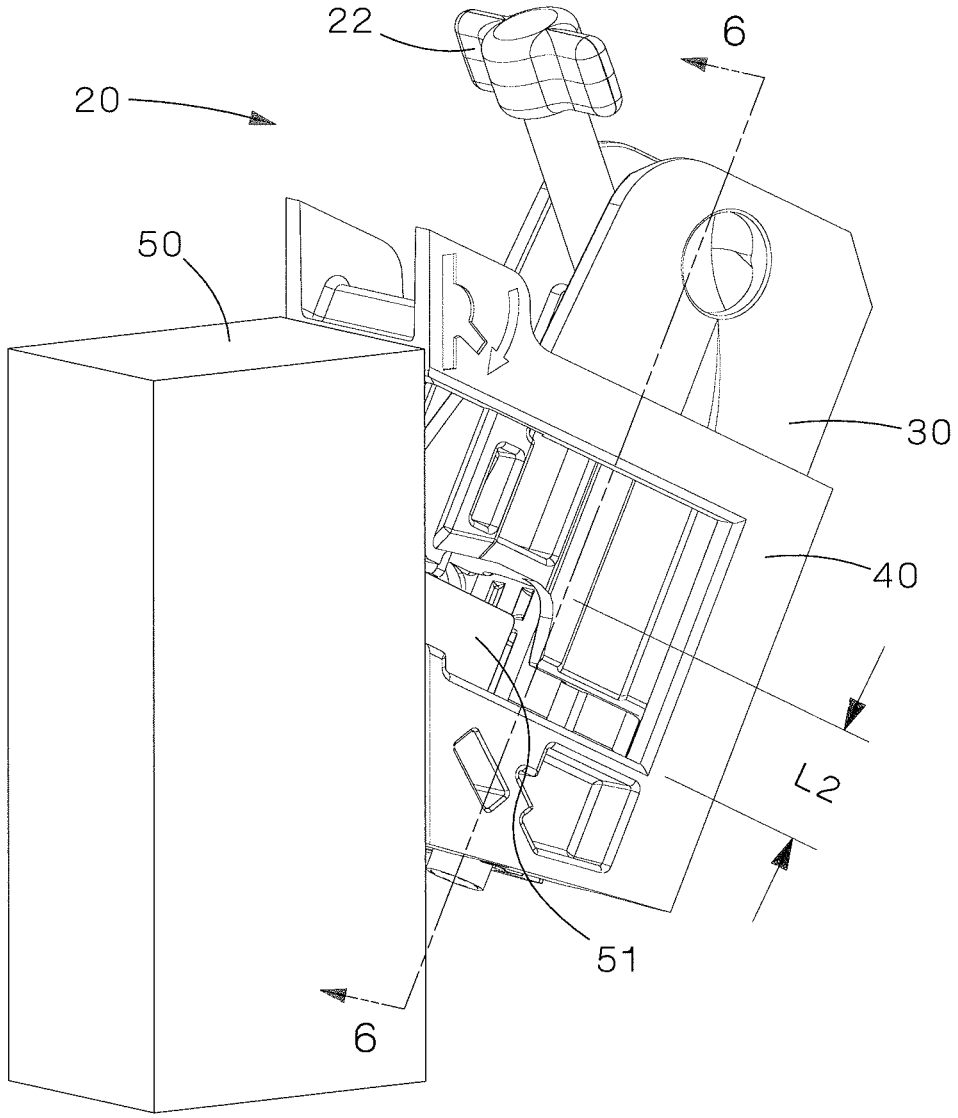
FIG. 5 is a perspective view of the circuit breaker lockout of FIG. 1 installed on a single pole circuit breaker.
Figure 6:
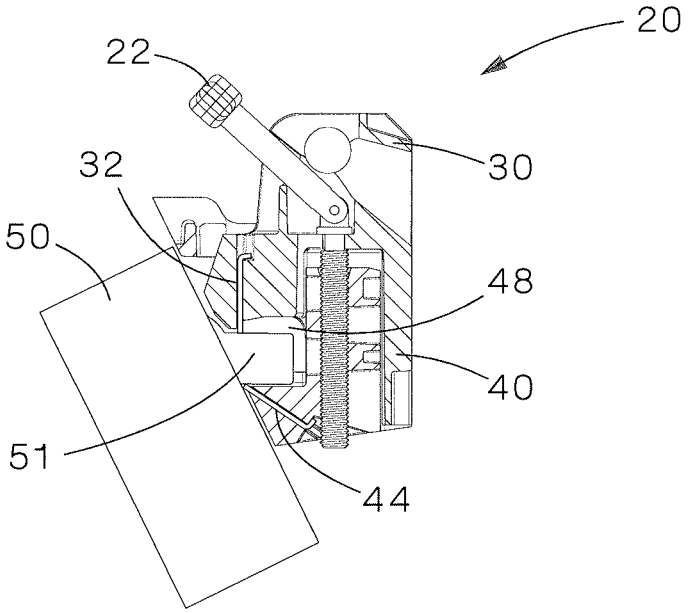
FIG. 6 is a cross sectional view of the circuit breaker lockout taken along line 6-6 of FIG. 5.
Figure 8:
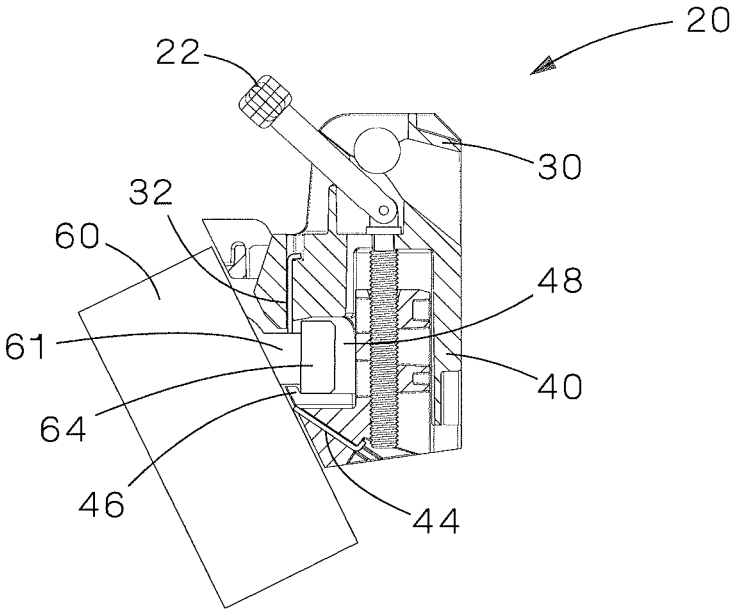
FIG. 8 is a cross sectional view of the circuit breaker lockout taken along line 8-8 of FIG. 7.
Figure 7:
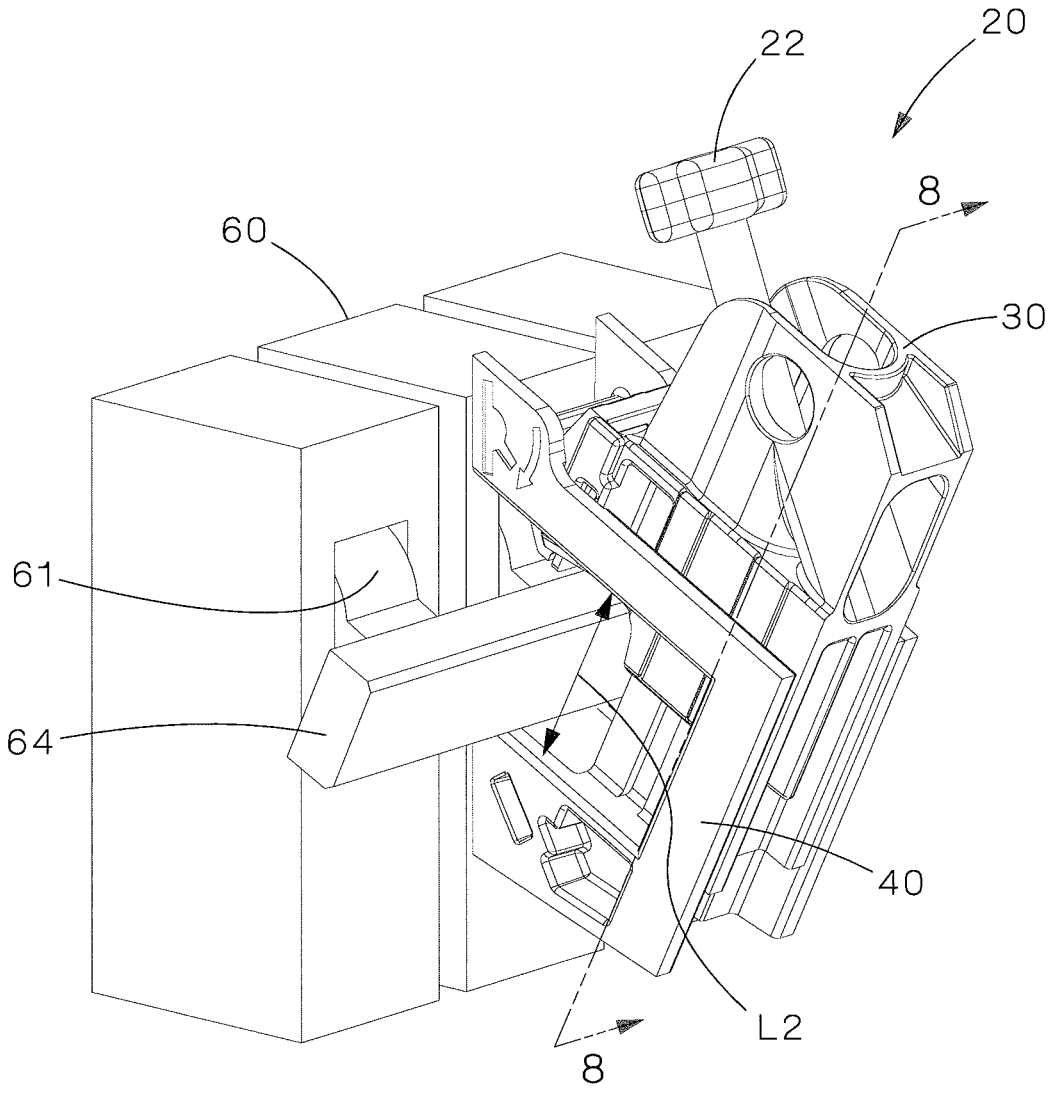
FIG. 7 is a perspective view of the circuit breaker lockout of FIG. 1 installed on a multi-pole circuit breaker.

The circuit breaker lockout 20 of the present invention is simple to install. The two piece lockout 20 is positioned on a circuit breaker. As discussed above, the circuit breaker lockout 20 is designed to be installed on single or multi-pole circuit breakers. As illustrated in FIGS. 5 and 6, the circuit breaker lockout 20 is installed on a single circuit breaker 50. As illustrated in FIGS. 7 and 8, the circuit breaker lockout 20 is installed on a multi-pole circuit breaker 60.

Once the lockout 20 is positioned on the breaker(s), the lockout 20 is tightened via the toggle screw 22 or a tool engages the set screw 24. As the screw is actuated, the jaw 40 slides with respect to the base 30 decreasing the first length L1 of the open center 48 to a second length L2. As a result, the lockout 20 surrounds a switch of the circuit breaker. As illustrated in FIG. 6, the metal blades 32, 44 engage the switch 51 as the lockout 20 is closed. As illustrated in FIG. 8, the blade 32 in the base 30 and the teeth 46 molded into the jaw 40 reach behind the tie bar 64 as the lockout 20 is closed. As a result, the lockout 20 generates a firm hold on the switch of the circuit breaker without damaging the circuit breaker.

Figure 9:
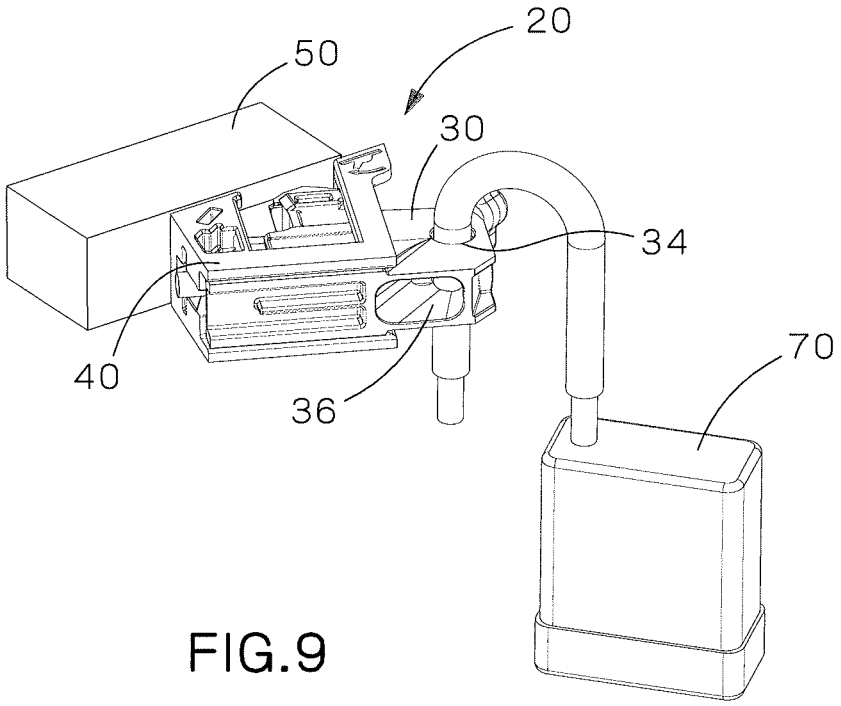
FIG. 9 is a bottom perspective view of the circuit breaker lockout of FIG. 1 installed on a single pole circuit breaker and a padlock installed in a transverse mounting position.
Figure 10:
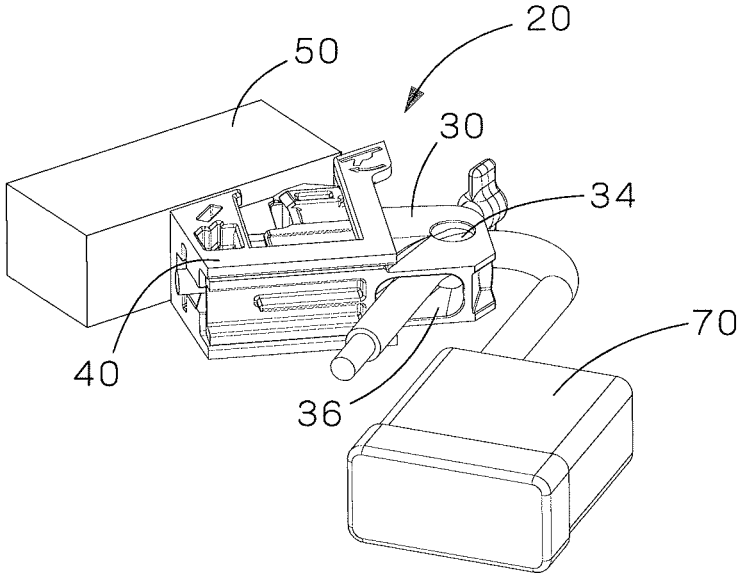
FIG. 10 is a bottom perspective view of the circuit breaker lockout of FIG. 1 installed on a single pole circuit breaker and a padlock installed in a longitudinal mounting position.

Once the lockout 20 is secured, a padlock 70 can be installed in one of two positions. The padlock ensures that the lockout can not be removed from the breaker switch by maintaining the toggle screw in a locked position. As illustrated in FIG. 9, the padlock 70 may be installed in the circuit breaker lockout 20 in a transverse direction through the lock hole 34. The transverse padlock position is preferable when a single lockout is used and there is no chance in interference. Alternatively, as illustrated in FIG. 10, the padlock 70 may be installed in a longitudinal direction following the length of the lockout through the lock hole 36. The longitudinal padlock position is necessary when the circuit breakers adjacent to each other in a panel need to be locked out.

As discussed above, the circuit breaker lockout of the present invention provides a secure device that prevents unwanted access to the circuit breaker. The lockout is easy to install and versatile since one lockout fits a one, two, or three pole circuit breaker. Finally the lockout design with the metal blades and teeth provides an improved grip and eliminates damage to the circuit breaker switches.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation.

The invention claimed is:

1. A circuit breaker lockout comprising:

a base having a top and a bottom:

a screw positioned within the base; and a jaw having a top, a bottom and sides defining an open center having a first length, wherein the base being positioned between the sides of the jaw in the open center, the bottom of the base extending in the open center and the top of the base extending above the top of the jaw;

wherein the base having an upper blade and the jaw having a lower blade, the upper blade is positioned to extend in the open center of the jaw and the lower blade is positioned at end of the jaw;

wherein the jaw slides with respect to the base when the screw is actuated thereby decreasing the first length of the open center to a second length for enabling the lockout to surround a switch of a circuit breaker.

2. The circuit breaker lockout of claim 1, wherein the upper blade extending from the bottom of the base for engaging the circuit breaker, the upper blade is positioned in a vertical direction with respect to the base.

3. The circuit breaker lockout of claim 1, wherein the lower blade is positioned at an angle with respect to the jaw.

4. The circuit breaker lockout of claim 1, wherein the upper blade and the lower blade being offset from each other for gripping the circuit breaker.

5. The circuit breaker lockout of claim 1, wherein the upper blade engages a free end of the circuit breaker switch and the lower blade engages the circuit breaker switch closer to the circuit breaker.

6. The circuit breaker lockout of claim 1, wherein the upper blade and the lower blade are metal.

7. The circuit breaker lockout of claim 1, wherein the jaw further comprising teeth molded into the end of the jaw, whereby the teeth ensure the lockout is positioned on the circuit breaker.

8. The circuit breaker lockout of claim 1, wherein the circuit breaker lockout is installed on a single circuit breaker.

9. The circuit breaker lockout of claim 1, wherein the circuit breaker lockout is installed on a multi-pole circuit breaker.

10. A circuit breaker and a circuit breaker lockout secured on the circuit breaker, the combination comprising:

a circuit breaker having a switch;

a lockout having a base with a top and a bottom; a screw positioned within the base; and a jaw having a top, bottom and sides defining an open center having a first length;

wherein the base being positioned between the sides of the jaw in the open center, the bottom of the base extending in the open center and the top of the base extending above the top of the jaw;

wherein the open center of the jaw receives the switch of the circuit breaker;

wherein the jaw slides with respect to the base when the screw is actuated thereby decreasing the first length of the open center to a second length to enable the base and the jaw to surround the switch of the circuit breaker.

11. The circuit breaker and the circuit breaker lockout of claim 10, wherein the base having an upper blade extending from the bottom of the base for engaging the circuit breaker, the upper blade is positioned in a vertical direction with respect to the base.

12. The circuit breaker and the circuit breaker lockout of claim 10, wherein the jaw having a lower blade for engaging the circuit breaker, the lower blade is positioned at an angle with respect to the jaw.

13. The circuit breaker and the circuit breaker lockout of claim 12, wherein the jaw having an end located at an opening of the open center, the lower blade positioned at the end of the jaw.

14. The circuit breaker and the circuit breaker lockout of claim 10, wherein the base having an upper blade and the jaw having a lower blade, the upper blade and the lower blade being offset from each other for gripping the circuit breaker.

15. The circuit breaker and the circuit breaker lockout of claim 14, wherein the upper blade is positioned to extend in the open center and the lower blade is positioned at an end of the jaw, wherein the upper blade engages a free end of the circuit breaker switch and the lower blade engages the circuit breaker switch closer to the circuit breaker.

16. The circuit breaker and the circuit breaker lockout of claim 14, wherein the circuit breaker is a single pole circuit breaker; wherein the upper blade and the lower blade engage the switch of the single pole circuit breaker as the lockout is closed.

17. The circuit breaker and the circuit breaker lockout of claim 10, wherein the upper blade and the lower blade are metal.

18. The circuit breaker and the circuit breaker lockout of claim 10, wherein the jaw further comprising teeth molded into an end of the jaw, whereby the teeth ensure the lockout is positioned on the circuit breaker.

19. A circuit breaker and a circuit breaker lockout secured on the circuit breaker, the combination comprising:

a circuit breaker having a switch;

a lockout having a base with a top and a bottom; a screw positioned within the base; and a jaw having a top, bottom and sides defining an open center having a first length;

wherein the base being positioned between the sides of the jaw in the open center, the bottom of the base extending in the open center and the top of the base extending above the top jaw;

wherein the jaw slides with respect to the base when the screw is actually thereby decreasing the first length of the open center to a second length for enabling the lock-out to surround the switch of the circuit breaker;

wherein the base having an upper blade and the jaw having a lower blade, the upper blade and the lower bade being offset from each other for gripping the circuit breaker; and wherein the circuit breaker is a multi-pole circuit breaker; wherein the jaw further comprising teeth mold into an end of the jaw, wherein the upper blade and the teeth reach behind a tie bar of the multi-pole circuit breaker as the lockout is closed.

* * * * *